United States Patent [19]

Karl

[11] 4,053,106

[45] Oct. 11, 1977

[54] SYSTEM FOR UTILIZING HEAT CONTAINED IN FLUE GAS

[76] Inventor: Robert Karl, 97-22 Metropolitan Ave., Forest Hills, N.Y. 11375

[21] Appl. No.: 737,938

[22] Filed: Nov. 2, 1976

[51] Int. Cl.[2] ..... F24D 3/00

[52] U.S. Cl. ..... 237/8 R; 122/20 B; 165/39

[58] Field of Search ..... 237/54, 55, 8 R, 12.3 B; 122/DIG. 1, 20 B; 126/132, 117; 165/35, 39

[56] References Cited

U.S. PATENT DOCUMENTS

| | | | |
|---|---|---|---|
| 623,138 | 4/1899 | Crocker | 165/54 |
| 1,190,396 | 7/1916 | Frazer | 237/54 |
| 1,633,759 | 6/1927 | Breese | 165/35 |
| 1,870,809 | 8/1932 | Handy | 165/35 |
| 3,813,039 | 5/1974 | Wells | 165/DIG. 2 |
| 3,997,108 | 12/1976 | Mason | 237/50 |

FOREIGN PATENT DOCUMENTS

| | | | |
|---|---|---|---|
| 79,046 | 2/1919 | Switzerland | 165/DIG. 2 |

*Primary Examiner*—William E. Wayner
*Assistant Examiner*—Robert J. Charvat
*Attorney, Agent, or Firm*—C. Bruce Hamburg

[57] ABSTRACT

In combination with a heating system comprising a boiler, combustion means for heating water contained in the boiler and a flue for conducting away hot gases resulting from the combustion, the invention comprises a system for recovering heat contained in the flue gas comprising a housing having a flue gas inlet and a flue gas outlet, contained in the housing a coil having a water inlet and a water outlet, director means for directing flue gas into a first path of contact with the coil as the flue gas travels from the flue gas inlet to the flue gas outlet or a second path directly from the flue gas inlet to the flue gas outlet without contacting the coil and means for adjusting the directing means between a first position at which the flue gas is directed into the first path and a second position at which the flue gas is directed into the second path. There may also be provided means for sensing the temperature of water heated in the coil by the flue gas, a motor operatively connected to the directing means and means for actuating the motor in response to the temperature sensed by the sensing means.

1 Claim, 4 Drawing Figures

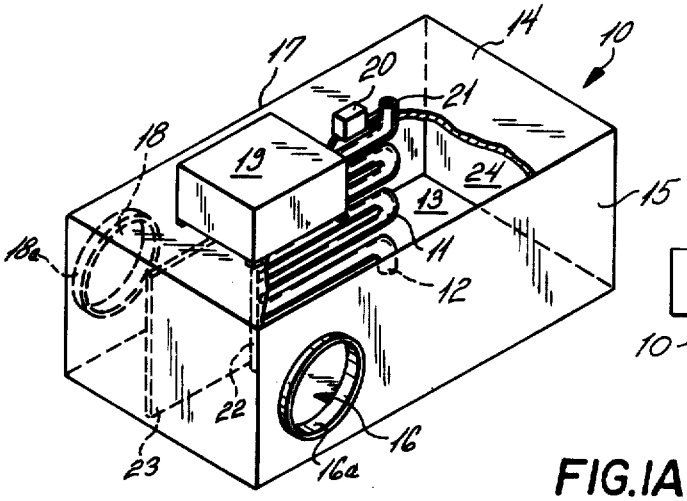
FIG. 1
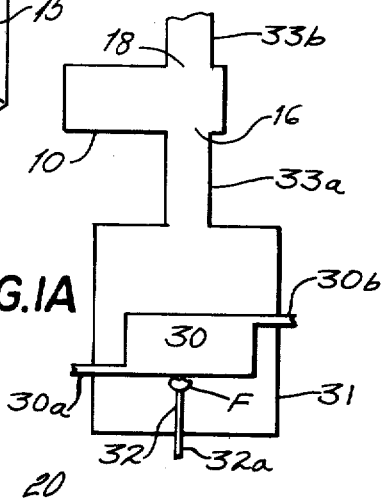
FIG.1A
FIG. 2
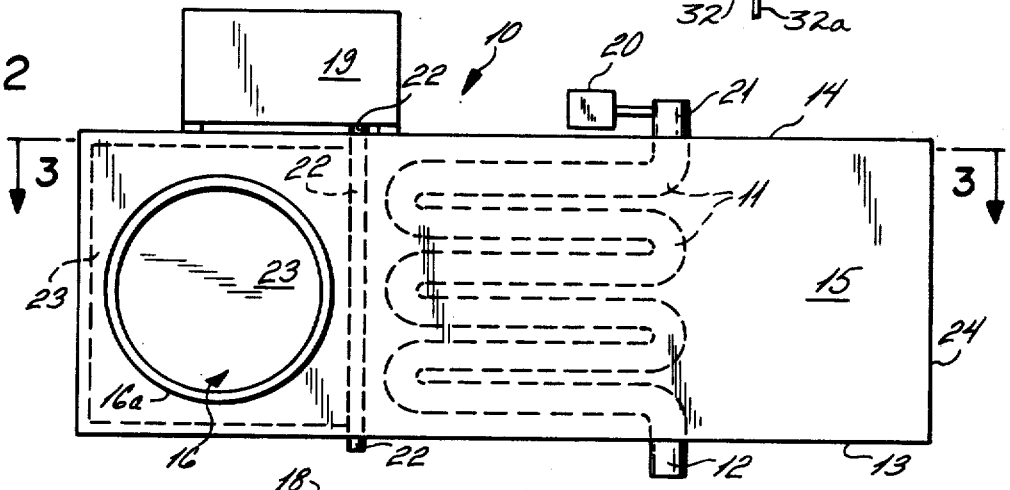
FIG. 3
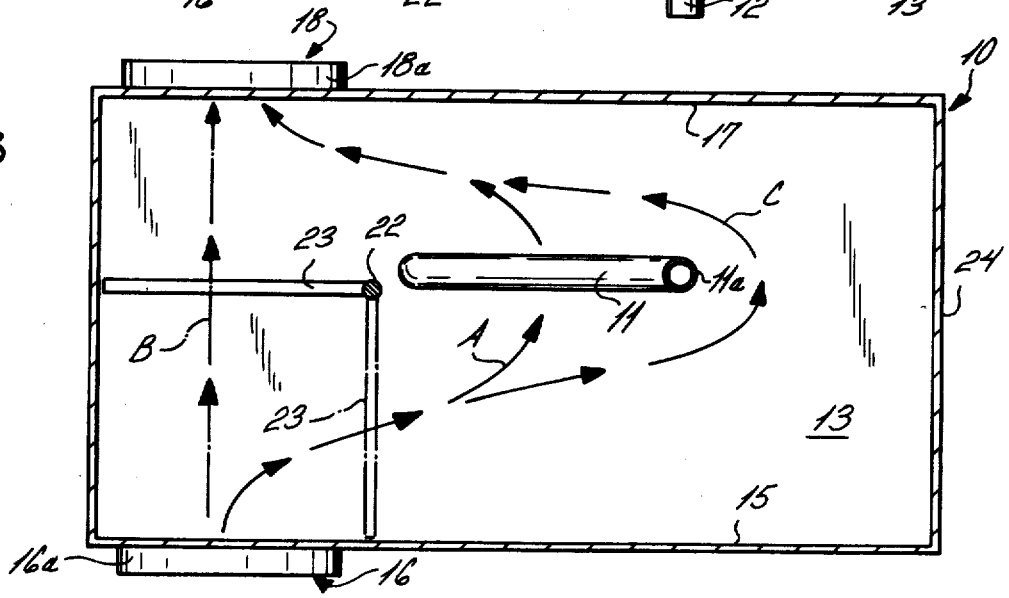

SYSTEM FOR UTILIZING HEAT CONTAINED IN FLUE GAS

BACKGROUND OF THE INVENTION

This invention relates to a system for recovering heat contained in the flue gas of a heating system in which combustion heats water in a boiler.

A common type of heating system comprises a boiler, combustion means for heating water contained in the boiler and a flue for conducting away hot gases resulting from the combustion. The combustion means may be a furnace fired by oil, gas, coal, wood or the like. In home heating systems, the combustion is most commonly fired by oil or gas. In any event, heat from the combustion and the hot combustion gases is utilized to heat water in a boiler to produce hot water for domestic use and either hot water for a hot water heating system or steam for a steam heating system. However, a substantial amount of heat is not removed from the hot combustion gases and this heat is wasted when the hot combustion gases go up the chimney. Since these gases pass through a flue connecting the furnace to the chimney, these gases are commonly known as "flue gas."

It is an object of this invention to provide a system for use in conjunction with conventional heating systems of the aforementioned common type for recovering heat from flue gas which heat has heretofore been wasted.

Other objects and advantages of the invention will be apparent from the following description.

SUMMARY OF THE INVENTION

According to the invention, there is provided in combination with a heating system comprising a boiler, combustion means for heating water contained in the boiler and a flue for conducting away hot gases resulting from the combustion, a novel system for recovering heat contained in the flue gas. The system comprises a housing having a flue gas inlet and a flue gas outlet, contained in the housing a coil having a water inlet and a water outlet, director means for directing flue gas into a first path of contact with the coil as the flue gas travels from the flue gas inlet to the flue glue gas outlet or a second path directly from the flue gas inlet to the flue gas outlet without contacting the coil and means for adjusting the directing means between a first position at which the flue gas is directed into the first path and a second position at which the flue gas is directed into the second path.

The system according to the invention may further comprise means for sensing the temperature of water heated in the coil by the flue gas, a motor operatively connected to the directing means for adjusting the directing means and means for actuating the motor in response to the temperature sensed by the sensing means whereby flue gas is directed into the first path when the temperature of the water in the coil is below a desired level and into the second path when the temperature of the water in the coil is above a desired level.

DESCRIPTION OF A PREFERRED EMBODIMENT

The invention will now be further described by reference to a specific embodiment as illustrated in the drawings, in which:

FIG. 1 is an isometric view, partly broken away, of a flue gas heat recovery system according to the invention;

FIG. 1A is a block diagram schematically illustrating the heat recovery device of the invention in combination with a boiler, combustion means for heating water contained in the boiler and a flue for conducting away hot gases resulting from the combustion;

FIG. 2 is a front elevation of the system of FIG. 1; and

FIG. 3 is a sectional view, on line 3—3 of FIG. 2, of the system of FIG. 1.

The heat recovery system according to the invention includes a housing 10 in the form of a rectilinear box (FIG. 1). Mounted in the housing 10 is a conventional serpentine coil 11 for conducting water to be heated by the hot flue gas. An inlet fitting 12 for the coil 11 extends through and below the bottom wall 13 of the housing 10 and an outlet fitting 21 for the coil 11 extends through and above the top wall 14 of the housing 10 (FIG. 2). To the outlet fitting 21 are connected a relay and thermostat, "Aquastat" (trade mark) or like control means 20 for controlling the temperature to which water in the coil 11 is heated. In the front wall 15 of the housing 10 is provided a flue gas inlet opening 16 provided with an annular flange **16*a* for connection to a segment of flue pipe running from the furnace, and in the rear wall 17 of the housing 10 is provided a flue gas outlet opening 18 provided with a flange 18*a* for connection to a segment of flue pipe running to the chimney (FIG. 3). Mounted on the top wall 14 of the housing 10 is a motor 19. The motor 19 drives a shaft 22 which is journalled in the top and bottom walls 14 and 13 of the housing 10. Fixed to the shaft 22 is a director 23** in the form of a sheet metal plate.

In FIG. 1A, a boiler 30 having a water inlet line **30*a* and a water outlet line 30*b* is mounted in a boiler housing or furnace 31. The water in the boiler 30 is heated by means of a flame F emanating from a burner nozzle 32 supplied with gas or oil through a supply line 32*a*. A flue pipe segment 33*a* conducts flue gas from the furnace 31 to the flue gas inlet opening 16 of the housing 10 of the heat recovery system according to the invention and a flue pipe segment 33*b* conducts flue gas from the flue gas outlet opening 18 of the housing 10** to a chimney (not illustrated).

The illustrated heat recovery system is installed and operates in the following manner. A segment of flue pipe extending from the furnace is connected to the inlet opening 16, the flange **16*a* thereof being sized to receive the flue pipe with a snug fit. A segment of flue pipe extending to the chimney is connected to the outlet opening 18, the flange 18*a* thereof being sized to receive the flue pipe with a snug fit. A water supply pipe is connected to the coil inlet fitting 12. Another water pipe is connected to the coil outlet fitting 21 and feeds into a hot water radiator, a hot water faucet, a hot water storage tank or the like, whereby heat recovered by the coil 11 can be made of practical use. The relay and thermostat 20 are connected to an electric power source and are electrically connected to the motor 19 for controlling the motor 19**.

The thermostat is so set that when the temperature of the water in the coil 11 is below a predetermined level, the director 23 is in the position shown in solid line in FIG. 3, and when the temperature of the water in the coil 11 is at or above that predetermined level, the director 23 is in the position shown in broken line in FIG. 3. More specifically, when the temperature of the water in the coil 11 increases to a value at or above the predetermined level, the motor 19 is actuated by the relay and thermostat 20 to move the director 23 from the solid line position to the broken line position, and when the temperature of the water in the coil 11 decreases to a temperature below the predetermined level, the motor 19 is actuated by the relay and thermostat 20 to move the director 23 from the broken line position back to the solid line position. The details of such controls are welll known in connection with conventional thermostatically controlled dampers or directors in systems different from that of the present invention. In this way, the water heated in the coil 11 is kept at a desired temperature and the risk of overheating of the water and consequent failure of the system, for example by rupture of the coil 11, is avoided.

It is apparent that when the director 23 is in the solid line position, the flue gas is directed through the interstices of the serpentine configuration of the coil 11 in travelling from the flue gas inlet 16 to the flue gas outlet 18 (path "A"), whereby heat is transferred from the flue gas to the water in the coil 11, and when the director 23 is in the broken line position, the flue gas is directed from the flue gas inlet 16 to the flue gas outlet 18 directly, without contacting the coil 11 (path "B"), whereby heat is not transferred from the flue gas to the water in the coil 11.

A further safety feature is provided in the system of the present imvention. In particular, the risk of blocking the flow of flue gas away from the furnace and consequent possible explosion is avoided. To this end, in the housing 10 between the side 11*a* of the coil 11 remote from the director 23 and the side wall 24 of the housing 10 facing the side 11*a* of the coil 11 is provided ample space to permit the flue gas to flow therethrough and thus travel from the flue gas inlet 16 to the flue gas outlet 18 even if the director 23 is in the solid line position and the interstices in the coil 11 are blocked (path "C"), for example by soot.

While the invention has been particularly described with reference to a certain specific embodiment thereof, it is to be understood that such embodiment is intended to illustrate rather than to limit the invention and that variations and modifications obvious to one of ordinary skill in the art are intended to be encompassed by the hereto appended claims. For example, the housing 10 need not be rectilinear but may be fabricated from pipe or cylindrical conduit with appropriate modification of the shape of the director 23 to circular. Another example is that the motor 19 and relay and thermostat 20 may be eliminated and the director 23 moved to one position or the other manually, such as by means of a handle or knob attached to the shaft 22 on which the director 23 is mounted.

What is claimed is:

1. In combination with a heating system comprising a boiler, combustion means for heating water contained in the boiler and a flue for conducting away hot gases resulting from the combustion, the invention comprising a system for recovering heat contained in the flue gas comprising a housing having a flue gas inlet and a flue gas outlet in direct opposition to the flue gas inlet, a first path from the flue gas inlet to the flue gas outlet being defined by the shortest distance between the flue gas inlet and the flue gas outlet, contained in the housing laterally offset from and immediately adjacent said first path a coil having a water inlet and a water outlet, a second, longer path from the flue gas inlet to the flue gas outlet intersecting said coil, laterally offset from and immediately adjacent said coil an unobstructed space in said housing, a third, longest path from the flue gas inlet to the flue gas outlet including said unobstructed space, sole means for directing the flow of flue gas, said flue gas directing means comprising a directing plate pivotally mounted for movement between a first position in which it blocks the first path and a second position in which it blocks the second path, means for sensing the temperature of water heated in the coil by the flue gas, a motor operatively connected to said directing plate for pivoting said directing plate back and forth between said first and second positions and means for actuating the motor in response to the temperature sensed by the sensing means, whereby the directing plate is pivoted into the first position when the temperature of the water in the coil is below a desired level and the flue gas is thereby directed into the second path to further heat the water in the coil, the directing plate is pivoted into the second position when the temperature of the water in the coil is above a desired level and the flue gas is thereby directed into the first path to permit the water in the coil to cool and the third path permits the flue gas to flow from the flue gas inlet to the flue gas outlet in the event that the directing plate is in the first position and the second path becomes obstructed such as by the accumulation of soot in the interstices of the coil.

* * * * *